US010878780B2

(12) United States Patent
Zhu et al.

(10) Patent No.: US 10,878,780 B2
(45) Date of Patent: Dec. 29, 2020

(54) BRIGHTNESS ADJUSTMENT METHOD AND DEVICE FOR DISPLAY SCREEN, DISPLAY SCREEN AND DISPLAY APPARATUS

(71) Applicant: BOE TECHNOLOGY GROUP CO., LTD., Beijing (CN)

(72) Inventors: Wenxiu Zhu, Beijing (CN); Hualing Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/503,966

(22) Filed: Jul. 5, 2019

(65) Prior Publication Data

US 2020/0066229 A1 Feb. 27, 2020

(30) Foreign Application Priority Data

Aug. 24, 2018 (CN) ..... 2018 1 0973320

(51) Int. Cl.
*G09G 5/10* (2006.01)

(52) U.S. Cl.
CPC ..... *G09G 5/10* (2013.01); *G09G 2320/064* (2013.01); *G09G 2360/144* (2013.01)

(58) Field of Classification Search
CPC ..... G09G 5/10; G09G 2320/064; G09G 2360/144; G09G 2330/026; G09G 2320/0626; G09G 3/3208
See application file for complete search history.

(56) References Cited

U.S. PATENT DOCUMENTS

2008/0165203 A1* 7/2008 Pantfoerder ..... G06F 3/0416 345/589
2009/0219253 A1* 9/2009 Izadi ..... G06F 3/0421 345/173
2010/0156865 A1* 6/2010 Kreek ..... G09G 3/3406 345/207
2015/0212583 A1* 7/2015 Shen ..... G06F 3/005 345/156
2017/0092187 A1* 3/2017 Bergquist ..... G09G 3/20
2019/0042825 A1* 2/2019 He ..... H01L 27/3234
(Continued)

FOREIGN PATENT DOCUMENTS

CN 104240678 A 12/2014
CN 104538005 A 4/2015
(Continued)

OTHER PUBLICATIONS

First Office Action dated Oct. 25, 2019 corresponding to Chinese application No. 201810973320.3.

*Primary Examiner* — Premal R Patel
(74) *Attorney, Agent, or Firm* — Nath, Goldberg & Meyer; Joshua B. Goldberg

(57) ABSTRACT

The present disclosure provides a brightness adjustment method and device for a display screen, a display screen and a display apparatus, belongs to the field of display technology, and can solve the problem of inaccurate brightness adjustment of a display screen. The brightness adjustment method for a display screen includes: controlling a light sensor to detect an intensity of ambient light in a transition interval after the display screen displays a frame of image; and adjusting brightness of the display screen according to the intensity detected by the light sensor.

14 Claims, 2 Drawing Sheets

(56) References Cited

U.S. PATENT DOCUMENTS

| | | | | |
|---|---|---|---|---|
| 2019/0103446 | A1* | 4/2019 | Jang | G06F 3/044 |
| 2020/0056936 | A1* | 2/2020 | Lin | G01J 1/44 |
| 2020/0057883 | A1* | 2/2020 | Ge | G06K 9/00248 |

FOREIGN PATENT DOCUMENTS

| | | | |
|---|---|---|---|
| CN | 104580701 | A | 4/2015 |
| CN | 107979698 | A | 5/2018 |
| CN | 108182896 | A | 6/2018 |
| WO | 2012052609 | A1 | 4/2012 |

* cited by examiner

BRIGHTNESS ADJUSTMENT METHOD AND DEVICE FOR DISPLAY SCREEN, DISPLAY SCREEN AND DISPLAY APPARATUS

CROSS-REFERENCE TO RELATED APPLICATION

The present application claims priority to Chinese Patent Application No. 201810973320.3, filed on Aug. 24, 2018, the disclosure of which is hereby incorporated by reference in its entirety.

TECHNICAL FIELD

The present disclosure relates to the field of display technology, and in particular, to a brightness adjustment method for a display screen, a brightness adjustment device for a display screen, a display screen and a display apparatus.

BACKGROUND

Currently, a light sensor is usually located in a non-display area directly above a display screen, and display brightness of the screen is automatically adjusted by using the sensor to sense a change in intensity of external light to provide a user with a better visual effect.

As a screen-to-body ratio of the display screen gradually increases, the light sensor is required to be placed below the display screen for full screen display.

SUMMARY

In an aspect of the present disclosure, there is provided a brightness adjustment method for a display screen, including:

controlling a light sensor to detect an intensity of ambient light in a transition interval after the display screen displays a frame of image; and adjusting brightness of the display screen according to the intensity detected by the light sensor.

In some embodiments, the light sensor is controlled to detect the intensity of the ambient light after the display screen displays each frame of image.

In some embodiments, every preset number of the transition intervals in series form one intensity detection period;

the step of adjusting the brightness of the display screen according to the intensity detected by the light sensor includes:

obtaining, according to an intensity of the ambient light detected in each intensity detection period by the light sensor, display brightness of the display screen after the intensity detection period, and adjusting the brightness of the display screen according to the obtained display brightness of the display screen.

In some embodiments, an average value of detected intensities of the ambient light in the preset number of transition intervals in series of an intensity detection period serves as an intensity of the ambient light detected in the intensity detection period.

In some embodiments, every preset number of the transition intervals in series is one intensity detection period;

the step of adjusting the brightness of the display screen according to the intensity detected by the light sensor includes:

obtaining an intensity of the ambient light in a current transition interval and an intensity of the ambient light in each transition interval prior to the current transition interval detected by the light sensor in an intensity detection period to which the current transition interval belongs, when the light sensor detects that a difference between the intensity of the ambient light in the current transition interval and an intensity of the ambient light in a previous transition interval is greater than a preset value; obtaining display brightness of the display screen after the current transition interval by using a preset algorithm; and adjusting the brightness of the display screen according to the obtained display brightness of the display screen.

In some embodiments, the preset algorithm includes an interpolation algorithm.

In some embodiments, the light sensor is controlled to detect the intensity of the ambient light in only one transition interval in every adjacent plurality of transition intervals.

In some embodiments, the brightness adjustment method further includes:

controlling the display screen not to perform display for a preset time period and controlling the light sensor to detect the intensity of the ambient light after the display screen is awakened, and controlling the display brightness of the display screen after the display screen is awakened according to the intensity detected by the light sensor.

In another aspect of the present disclosure, there is provided a brightness adjustment device for a display screen, including:

a light sensor configured to detect an intensity of ambient light;

a timing controller configured to control the light sensor to detect the intensity of the ambient light the in a transition interval after the display screen displays a frame of image; and a brightness adjustment unit configured to adjust brightness of the display screen according to the intensity detected by the light sensor.

In some embodiments, the timing controller is configured to control the light sensor to detect the intensity of the ambient light in each transition interval after the display screen displays a respective one frame of image.

In some embodiments, every preset number of the transition intervals in series form one intensity detection period; and the brightness adjustment unit is configured to obtain, according to an intensity of the ambient light detected in each intensity detection period by the light sensor, display brightness of the display screen after the intensity detection period, and adjust the brightness of the display screen according to the obtained display brightness of the display screen.

In some embodiments, an average value of detected intensities of the ambient light in the the preset number of transition intervals in series of an intensity detection period serves as an intensity of the ambient light detected in the intensity detection period.

In some embodiments, every preset number of the transition intervals in series form one intensity detection period; and the brightness adjustment unit is configured to obtain, when the light sensor detects that a difference between the intensity of the ambient light in the current transition interval and an intensity of the ambient light in a previous transition interval is greater than a preset value, an intensity of the ambient light in a current transition interval and an intensity of the ambient light in each transition interval prior to the current transition interval detected by the light sensor in an intensity detection period to which the current transition interval belongs, obtain display brightness of the display screen after the current transition interval by using a preset algorithm, and adjust the brightness of the display screen according to the obtained display brightness of the display screen.

In some embodiments, the preset algorithm includes an interpolation algorithm.

In some embodiments, the timing controller is further configured to: control the display screen not to perform display for a preset time period and control the light sensor to detect the intensity of the ambient light after the display screen is awakened.

In some embodiments, the timing controller is configured to control the light sensor to detect the intensity of the ambient light in only one transition interval of every adjacent plurality of transition intervals.

In still another aspect of the present disclosure, there is provided a display screen including the brightness adjustment device as described above.

In still yet another aspect of the present disclosure, there is provided a display apparatus including the display screen as described above.

DETAILED DESCRIPTION

To enable those skilled in the art to better understand technical solutions of the present disclosure, the present disclosure will be further described in detail below in conjunction with the drawings and specific implementations.

In a case where a light sensor is disposed below the display screen, currently, the light sensor continuously receives ambient light, which means that the ambient light passes through the display screen and is received by the light sensor. However, the light sensor receives not only the ambient light but also light emitted by a light-emitting device and reflected back from the outside, so that the brightness of the screen cannot be accurately adjusted if the reflected light has an intensity (i.e., light intensity) greater than the intensity of the ambient light.

In order to substantially obviate one or more of the problems due to limitations and disadvantages of the related art, the present disclosure provides, inter alia, a brightness adjustment method for a display screen and a brightness adjustment device for a display screen that can precisely adjust brightness of the display screen, a display screen and a display apparatus.

According to an aspect of the present disclosure, embodiments of the present disclosure provide a brightness adjustment method for a display screen.

First, an operating sequence of a display screen is briefly introduced. In an embodiment, brightness adjustment on an organic light emitting diode (OLED) display screen is taken as an example. For display of each frame of image of this type of display screen, each row of pixel units (each pixel unit at least includes a switching transistor, a driving transistor, a storage capacitor, and an OLED device) are turned on by scanning gate lines row by row, and data voltage signals are supplied to data lines to enable OLED device in the respective pixel units to emit light. The end of display of each frame of image is followed by a transition interval (a time period between display of two frames of image), and no data voltages are applied to the data lines in the transition interval, so that each OLED device in the display screen does not emit light in the transition interval. It should be noted here that because the transition interval is very short, human eyes will not notice that the OLED device does not emit light in this interval, i.e., the transition interval does not affect the display effect of the display screen.

Thereinafter, a brightness adjustment method for a display screen according to an embodiment will be described.

Figure 1:
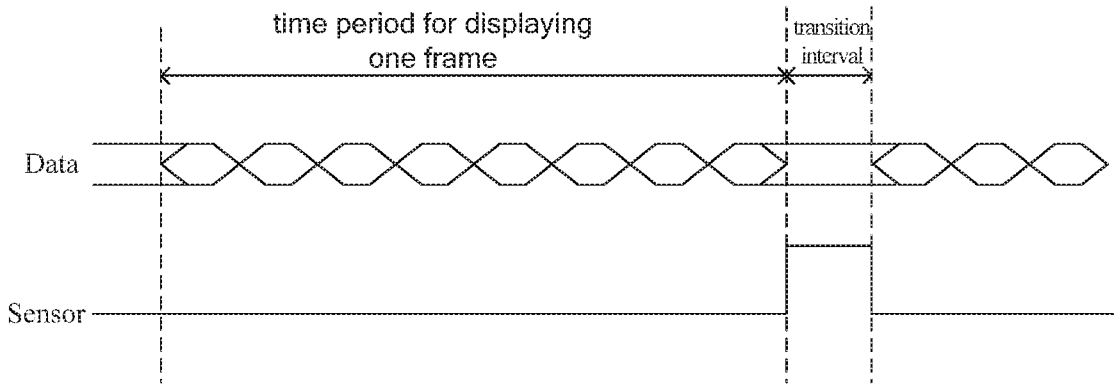
FIG. 1 is a sequence diagram of a brightness adjustment method for a display screen according to an embodiment of the present disclosure.
Figure 2:
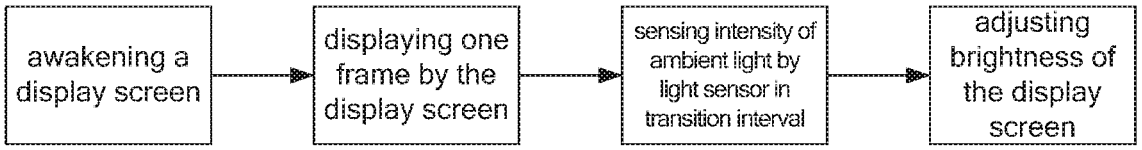
FIG. 2 is a flow chart of a brightness adjustment method for a display screen according to an embodiment of the present disclosure.

FIG. 1 is a sequence diagram of a brightness adjustment method for a display screen according to an embodiment of the present disclosure. FIG. 2 is a flow chart of a brightness adjustment method for a display screen according to an embodiment of the present disclosure. As shown in FIGS. 1 and 2, the brightness adjustment method for the display screen in the embodiment includes: controlling a light sensor to operate in a transition interval after the display screen displays one frame of image to detect an intensity of ambient light, and adjusting brightness of the display screen according to the intensity detected by the light sensor.

During display of the display screen, the display screen is refreshed at a frequency to display multiple frames of image, and each refresh cycle includes a time period for displaying one frame of image and a transition interval, as shown in FIG. 1. For example, in a case where the display screen is refreshed at a frequency of 60 Hz, each refresh cycle is about 16.7 ms, and in this case, the sum of the time period for displaying one frame of image and the transition interval is about 16.7 ms. As shown in FIG. 1, in a time period during which the display screen displays one frame of image (i.e., in a time period for displaying one frame of image), a data voltage is input to a data line Data to enable the display screen to display normally, and in this time period the light sensor does not operate. After the time period during which the display screen displays one frame of image, the input of the data voltage signal is stopped. i.e., the transition interval is entered, and in the transition interval, an operating voltage level signal (e.g., the operating voltage level may be a high level signal) is input to a sensing line Sensor that controls operation of the light sensor to cause the light sensor to detect an intensity of ambient light and brightness of the display screen is adjusted according to the intensity detected by the light sensor.

In the brightness adjustment method for the display screen of the embodiment, the light sensor is controlled to operate in the transition interval, and the OLED device in the display screen does not operate in the transition interval, and therefore, in this case, the intensity detected by the light sensor must be intensity of the ambient light. As such, the brightness of the display screen can be precisely adjusted according to the intensity sensed by the light sensor.

In the brightness adjustment method for the display screen in the embodiment, the light sensor may be controlled by a timing controller to operate only when the OLED device in the display screen does not operate, and then according to the intensity of the ambient light sensed by the light sensor, the brightness of the display screen, which is to be adjusted to, is obtained by a brightness adjustment unit using pre-stored correspondence relationship between the intensity of the ambient light and the brightness of the display screen.

An implementation of the brightness adjustment method for the display screen in the embodiment will be described below.

In some embodiments, the display brightness of the display screen is adjusted once after the display screen displays a preset number of frames of image. The transition intervals each following display of a respective one frame of image in the preset number of frames of image constitute an intensity detection period, that is, every preset number of transition intervals in series (i.e., the preset number of transition intervals in the continuous preset number of refresh cycles) form one intensity detection period (i.e., one light intensity detection period).

The display time of each frame is short (e.g., in a case where the refresh rate of the display screen is 60 Hz, the display time of each frame is shorter than 16.7 ms), and the ambient light generally changes gradually, therefore, one intensity detection period may include a plurality of transition intervals. The number of the transition intervals included in one intensity detection period may be related to the refresh rate of the display screen. For example, in the case where the refresh rate of the display screen is 60 Hz, one intensity detection period may include 60 transition intervals, so that the brightness of the display screen can be adjusted once every minute. Needless to say, if it is desired to adjust the brightness of the display screen every half minute, one intensity detection period may include 30 transition intervals; or if it is desired to adjust the brightness of the display screen every two minutes, one intensity detection period may include 120 transition intervals, and the number of the transition intervals included in one intensity detection period is not limited in the present disclosure, and may be set as practically required.

After the display screen is awakened to perform normal display, the light sensor is controlled to detect the intensity of the ambient light in each transition interval until the intensities of the ambient light in the preset number of transition intervals in series are detected, i.e., detection in a first intensity detection period is completed. In an embodiment, an average value of detected intensities of ambient light in a preset number of transition intervals included in an intensity detection period is used as the intensity of the ambient light detected in the intensity detection period.

Brightness of an image displayed by the display screen in the next intensity detection period (i.e., in a second intensity detection period) is obtained according to the intensity of the ambient light detected in the first intensity detection period, and the brightness of the display screen is adjusted according to the obtained brightness, thereby adjusting the display brightness of the display screen.

In some embodiments, adjusting the brightness of the display screen according to the intensity detected by the light sensor may include: obtaining display brightness of the display screen according to pre-stored correspondence relationship between the intensity of the ambient light and the display brightness of the display screen, then obtaining a data voltage to be applied to a data line of the display screen according to pre-stored correspondence relationship between the display brightness of the display screen and the data voltage, and applying the data voltage to the data line, thereby realizing the brightness adjustment of the display screen.

In some embodiments, the light sensor is controlled to detect the intensity of the ambient light after the display screen displays multiple frames of image, that is, the light sensor is controlled to operate only once every a plurality of transition intervals to sense the intensity of the ambient light. For example, the light sensor may operate once every two transition intervals to obtain the intensity of the ambient light, thereby reducing power consumption.

In the case of a sudden change of ambient light (for example, when a user turns on or off a light), the light sensor detects that the intensity of the ambient light in the current transition interval is very different from the intensity detected in the previous transition interval, that is, the light sensor currently detects that a difference between the intensity of the ambient light in the current transition interval and the intensity of the ambient light in the previous transition interval is greater than a preset value. In this case, the intensity detection period in which the current transition interval is located is determined, and is recorded as the current intensity detection period. Then, the intensity of the ambient light in the current transition interval and the intensity of the ambient light in each transition interval prior to the current transition interval sensed by the light sensor in the current intensity detection period are acquired, the display brightness of the display screen after the current transition interval is obtained by using a preset algorithm, and the brightness of the display screen is adjusted.

The preset algorithm may be an interpolation algorithm. Needless to say, it is not limited to the interpolation algorithm to obtain the brightness of the display screen to be displayed.

For example, each intensity detection period includes 10 transition intervals. When detecting in the 15th transition interval, it is determined that the intensity of the ambient light in the 15th transition interval is much larger (or much smaller) than the intensity of the ambient light in the 14th transition interval, in this case, the 15th transition interval is the current transition interval, and the current intensity detection period is the second intensity detection period. Then, the intensity detected in each of the 11th to 15th transition intervals is acquired, and according to the acquired five intensities, the display brightness of the display screen after the 15th transition interval is obtained using the preset algorithm. To obtain the display brightness of the display screen, a data voltage to be applied to a data line of the display screen may be obtained according to the correspondence relationship between the display brightness of the display screen and the data voltage, and the data voltage is applied to the data line, thereby realizing the bright adjustment of the display screen.

This brightness adjustment method can be applied to a case where there is a sudden change in the environment where the display screen is located, in this way, the display brightness of the display screen can be adjusted in time without waiting until the intensity detection period ends to adjust the brightness of the display screen, so that the brightness of the display screen can be adjusted more timely.

Figure 3:
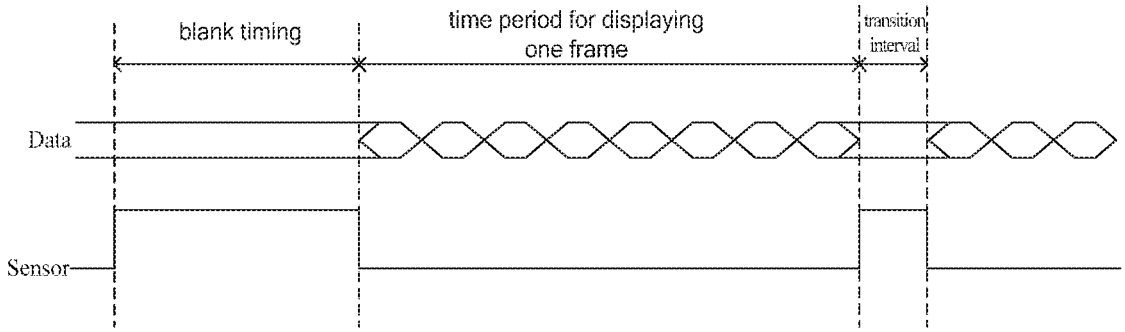
FIG. 3 is another sequence diagram of a brightness adjustment method for a display screen according to an embodiment of the present disclosure.
Figure 4:
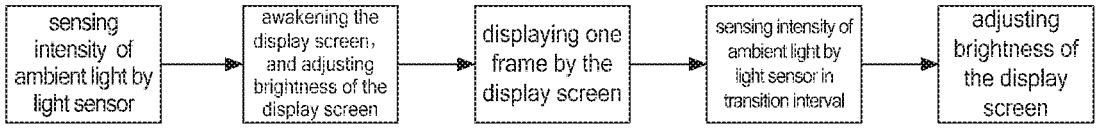
FIG. 4 is another flow chart of a brightness adjustment method for a display screen according to an embodiment of the present disclosure.

FIG. 3 is another sequence diagram of a brightness adjustment method for a display screen according to an embodiment of the present disclosure. FIG. 4 is another flow chart of a brightness adjustment method for a display screen according to an embodiment of the present disclosure. As shown in FIGS. 3 and 4, the brightness adjustment method for the display screen provided by the embodiment not only includes adjusting the brightness of the display screen after the display screen is awakened and performs normal display as described above, but also includes: controlling the display screen not to display within a preset time period after the display screen is awakened, i.e., controlling a signal input to the data line Data to have a blank timing, inputting an operating voltage level signal (e.g., the operating voltage level signal is a high level signal) to the sensing line Sensor that controls operation of the light sensor such that the light sensor operates to detect the intensity of the ambient light, and controlling brightness displayed by the display screen after being awakened (i.e., controlling an original brightness displayed by the display screen before displaying the first frame of image) according to the intensity detected by the light sensor. The preset time period may be substantially equal to or slightly shorter than one refresh cycle of the display screen, which is not limited in the present disclosure, as long as the light sensor can obtain the intensity of the ambient light in the preset time period without adversely affecting the viewing experience of a user.

In this way, at the beginning of normal display of the display screen, the brightness displayed by the display screen is based on the intensity of the ambient light, so as to prevent the display screen from being too bright or too dark at the beginning of the display of the display screen to affect the user's experience.

Figure 5:
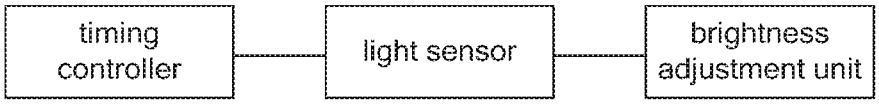
FIG. 5 is a schematic diagram of a brightness adjustment device for a display screen according to an embodiment of the present disclosure.

In another aspect, embodiments of the present disclosure provide a brightness adjustment device for a display screen, which can be used to implement the above brightness adjustment method. As shown in FIG. 5, the brightness adjustment device includes: a light sensor, a timing controller, and a brightness adjustment unit.

The light sensor is configured to detect intensity of ambient light, and may be any sensor that can sense intensity of light.

The timing controller is configured to control the light sensor to operate in a transition interval after the display screen displays one frame of image.

The brightness adjustment unit is configured to adjust brightness of the display screen according to the intensity detected by the light sensor. In an embodiment, the brightness adjustment unit may be implemented as a memory and a processor coupled to one another, the memory stores correspondence relationship between the intensity of the ambient light and the display brightness of the display screen, correspondence relationship between the display brightness of the display screen and the data voltage, and computer-executable instructions, and when the computer-executable instructions are executed by the processor, the process is caused to obtain, according to the received intensity sensed by the light sensor, the brightness of the display screen corresponding to the intensity sensed by the light sensor and obtain the data voltage to be applied to the data line of the display screen, thereby adjusting the brightness of the display screen by controlling the data voltage applied to the data line. Examples of suitable memories include, but are not limited to, magnetic disc or magnetic tape; optical storage media such as compact discs (CDs) or DVDs (digital versatile discs); flash memory; and other non-transitory media. In an embodiment, the memory is a non-transitory memory. Needless to say, the brightness adjustment unit according to the embodiments of the present disclosure is not limited thereto, and may be implemented in other form in which software and hardware are combined.

The brightness adjustment device for the display screen of the embodiment includes a light sensor, a timing controller, and a brightness adjustment unit, the light sensor may be controlled by the timing controller to operate in the transition interval, and OLED devices in the display screen do not operate during the transition interval, and therefore, the intensity sensed by the light sensor must be intensity of the ambient light. As such, the brightness of the display screen can be precisely adjusted according to the intensity sensed by the light sensor.

In an embodiment, the display brightness of the display screen is adjusted once after the display screen displays a preset number of frames of image; and all transition intervals each following display of a respective one frame of image in the preset number of frames constitute an intensity detection period. That is, every preset number of transition intervals form one intensity detection period.

The brightness adjustment unit in the embodiment may be configured to obtain, according to the intensity of the ambient light detected by the light sensor in each intensity detection period, the display brightness of the display screen after the intensity detection period to adjust the brightness of the display screen. For example, the brightness adjustment unit calculates an average value of intensities of ambient light detected by the light sensor in a preset number of transition intervals included in an intensity detection period as the intensity of the ambient light detected in the intensity detection period.

The brightness adjustment unit in the embodiment may be further configured to: obtain, when the light sensor detects that a difference between the intensity of the ambient light in the current transition interval and the intensity of the ambient light in a previous transition interval is greater than a preset value, the intensity of a current transition interval and the intensity of each transition interval prior to the current transition interval sensed by the light sensor in the intensity detection period (referred to as the current intensity detection period) to which the current transition interval belongs; obtain display brightness of the display screen after the current transition interval by using a preset algorithm; and adjust the brightness of the display screen according to the obtained display brightness of the display screen. The preset algorithm may be an interpolation algorithm.

The timing controller in the embodiment is further configured to: after the display screen is awakened, control the display screen not to display within a preset time period, and control the light sensor to operate to sense ambient light, so that the brightness adjustment unit adjusts the display brightness of the display screen. The preset time period may be substantially equal to or slightly shorter than one refresh cycle of the display screen. In this way, the brightness displayed by the display screen is based on the intensity of the ambient light even at the beginning of normal display of the display screen, so as to prevent the display screen from being too bright or too dark at the beginning of the display of the display screen to affect the user's experience.

In still another aspect, embodiments of the present disclosure further provide a display screen including the brightness adjustment device provided by the embodiments of the present disclosure. Since the display screen of the embodiment includes the above-described brightness adjustment device, the display screen can achieve precise adjustment of brightness.

In still yet another aspect, embodiments of the present disclosure further provide a display apparatus including the display screen provided by the embodiments of the present disclosure. Since the display apparatus of the embodiment includes the above-described brightness adjustment device, the display apparatus can achieve precise adjustment of brightness.

The display apparatus may be a liquid crystal display apparatus or an electroluminescence display apparatus, such as an OLED panel, an electronic paper, a mobile phone, a tablet computer, a television, a display, a notebook computer, a digital photo frame, a navigator, or any display product or component having a display function.

It could be understood that the foregoing implementations are merely exemplary implementations employed to explain the principles of the present disclosure, but the present disclosure is not limited thereto. Various modifications and improvements may be made by those skilled in the art without departing from the spirit and scope of the present disclosure, and these modifications and improvements are also considered to be within the protection scope of the present disclosure.

What is claimed is:

1. A brightness adjustment method for a display screen, comprising steps of:

controlling a light sensor to detect an intensity of ambient light in a transition interval after the display screen displays a frame of image; and adjusting brightness of the display screen according to the intensity detected by the light sensor, wherein the step of controlling a light sensor to detect an intensity of ambient light in a transition interval after the display screen displays a frame of image comprises: controlling the light sensor to detect the intensity of the ambient light after the display screen displays each frame of image, every preset number of the transition intervals in series form one intensity detection period; and the step of adjusting brightness of the display screen according to the intensity detected by the light sensor comprises:

obtaining, according to an intensity of the ambient light in each intensity detection period detected by the light sensor, display brightness of the display screen alter the intensity detection period, and adjusting the brightness of the display screen according to the obtained display brightness of the display screen.

2. The brightness adjustment method of claim 1, wherein the step of adjusting brightness of the display screen according to the intensity detected by the light sensor comprises:

obtaining an intensity of the ambient light in a current transition interval and an intensity of the ambient light in each transition interval prior to the current transition interval detected by the light sensor in an intensity detection period to which the current transition interval belongs, when the light sensor detects that a difference between the intensity of the ambient light in the current transition interval and an intensity of the ambient light in a previous transition interval is greater than a preset value;

obtaining display brightness of the display screen after the current transition interval by using a preset algorithm; and adjusting the brightness of the display screen according to the obtained display brightness of the display screen.

3. The brightness adjustment method of claim 2, wherein the preset algorithm comprises an interpolation algorithm.

4. The brightness adjustment method of claim 2, further comprising:

controlling the display screen not to perform display for a preset time period and controlling the light sensor to detect the intensity of the ambient light in the preset time period after the display screen is awakened, and controlling the display brightness of the display screen after the display screen is awakened according to the intensity detected by the light sensor.

5. The brightness adjustment method of claim 1, wherein an average value of detected intensities of the ambient light in the preset number of transition intervals in series of an intensity detection period serves as an intensity of the ambient light detected in the intensity detection period.

6. The brightness adjustment method of claim 1, further comprising:

controlling the display screen not to perform display for a preset time period and controlling the light sensor to detect the intensity of the ambient light in the preset time period after the display screen is awakened, and controlling the display brightness of the display screen after the display screen is awakened according to the intensity detected by the light sensor.

7. A brightness adjustment device for a display screen, comprising:

a light sensor, configured to detect an intensity of ambient light;

a timing controller, configured to control the light sensor to detect the intensity of the ambient light in a transition interval after the display screen displays a frame of image; and a brightness adjustment unit, configured to adjust brightness of the display screen according to the intensity detected by the light sensor, wherein the timing controller is configured to control the light sensor to detect the intensity of the ambient light in each transition interval after the display screen displays a respective one frame of image, every preset number of the transition intervals in series form one intensity detection period; and the brightness adjustment unit is configured to obtain, according to an intensity of the ambient light detected in each intensity detection period by the light sensor, display brightness of the display screen alter the intensity detection period, and adjust the brightness of the display screen according to the obtained display brightness of the display screen.

8. The brightness adjustment method of claim 7, wherein an average value of detected intensities of the ambient light in the preset number of transition intervals in series of an intensity detection period serves as an intensity of the ambient light detected in the intensity detection period.

9. The brightness adjustment device of claim 7, wherein the brightness adjustment unit is configured to obtain, when the light sensor detects that a difference between the intensity of the ambient light in the current transition interval and an intensity of the ambient light in a previous transition interval is greater than a preset value, an intensity of the ambient light in a current transition interval and an intensity of the ambient light in each transition interval prior to the current transition interval detected by the light sensor in an intensity detection period to which the current transition interval belongs, obtain display brightness of the display screen after the current transition interval by using a preset algorithm, and adjust the brightness of the display screen according to the obtained display brightness of the display screen.

10. The brightness adjustment device of claim 9, wherein the preset algorithm comprises an interpolation algorithm.

11. The brightness adjustment device of claim 9, wherein the timing controller is further configured to: control the display screen not to perform display for a preset time period and control the light sensor to detect the intensity of the ambient light after the display screen is awakened.

12. The brightness adjustment device of claim 7, wherein the timing controller is further configured to: control the display screen not to perform display for a preset time period and control the light sensor to detect the intensity of the ambient light after the display screen is awakened.

13. A display screen, comprising the brightness adjustment device of claim 7.

14. A display apparatus, comprising the display screen of claim 13.

* * * * *